United States Patent [19]

Boom

[11] Patent Number: 5,011,536

[45] Date of Patent: Apr. 30, 1991

[54] HANDLE FOR BABY WIPE CONTAINER

[76] Inventor: Mark V. Boom, 22627 Carolina, St. Clair Shores, Mich. 48080

[21] Appl. No.: 572,930

[22] Filed: Aug. 24, 1990

[51] Int. Cl.[5] ..... B08B 7/00
[52] U.S. Cl. ..... 134/6; 134/42
[58] Field of Search ..... 134/6, 42; 604/385.1

[56] References Cited

U.S. PATENT DOCUMENTS

| | | | |
|---|---|---|---|
| 1,742,279 | 1/1930 | Reynolds | 206/218 |
| 3,137,423 | 6/1964 | Tupper | 294/137 |
| 3,682,352 | 8/1972 | Doucette | 220/94 R |
| 3,692,202 | 9/1972 | Parlagreco | 220/276 |
| 4,101,026 | 7/1978 | Bonk | 206/205 |
| 4,206,529 | 6/1980 | Neumann | 15/264 |
| 4,462,507 | 7/1984 | Margulies | 221/63 |
| 4,536,889 | 8/1985 | Taylor et al. | 2/160 |
| 4,580,695 | 4/1986 | Lum | 221/52 |

OTHER PUBLICATIONS

"Wash-A-Bye Baby", Baby Wipe Container, Scott Paper Company, Philadelphia, Penna.

*Primary Examiner*—Theodore Morris
*Assistant Examiner*—Saeed Chaudhry
*Attorney, Agent, or Firm*—Dykema Gossett

[57] ABSTRACT

A handle and method of using the handle are described for use with baby wipe containers used to clean infants. The disclosed handle is utilized such that the baby wipe container is secured to the outer face of a user's first hand. The first hand is also used to secure the infant's legs while the user's second hand is used to remove wipes from the wipe container. This allows a user to perform three functions that a single user could not perform at a single time with the prior art containers. The container is secured on the outer surface of a user's one hand which also secures and infant's legs, such that two steps which in the prior art require two separate hands are performed by a user's single hand. This allows the user's other hand to perform the third step, and easily clean an infant.

8 Claims, 1 Drawing Sheet

HANDLE FOR BABY WIPE CONTAINER

BACKGROUND OF THE INVENTION

This invention in general relates to an improved handle for use on a baby wipe container that aids a user in cleaning an infant.

Baby wipes are typically used to clean an infant when changing the infant's diapers. One well known type of baby wipe container includes a generally cylindrical enclosure having a lid with a slot-like opening at the top through which wipes are removed. An example of this type of container is disclosed in U.S. Pat. No. 4,462,507. The container disclosed in this patent is quite beneficial and adequately stores the wipes.

Problems, however, exist when using this type of container in the cleaning of an infant. With this type of container it is normally necessary to use one hand to secure the container while pulling a wipe out of the slot. When cleaning an infant it is also necessary to use one hand to secure the legs of the infant. A single user would, of course, only have two hands, but needs three hands (one holding the container, one removing the wipe, and one securing the legs of the infant) to perform all the necessary steps with cleaning the infant. Thus it is sometimes difficult for a single user to use this type of container.

This is a real problem, since it is difficult to estimate how many wipes may be needed in any particular cleaning. Thus, the user may need to remove additional wipes while in the process of cleaning the infant. If the user is required to release the infant's legs to remove additional wipes, the infant may move about, which is undesirable during the cleaning process. The infant is usually soiled and by moving about can spread fecal or other materials around the area where the cleaning is being performed. This is undesirable.

It would be preferable to disclose a baby wipe container of this sort having a handle such that a user could use a single hand to secure both the container and the infants legs, while using the other hand to remove a wipe from the container.

The prior art does disclose various types of handles for distinct items. U.S. Pat. No. 3,137,423 discloses a removable handle which can be utilized with various storage members. The handle is apparently used for transporting the member.

U.S. Pat. No. 3,682,352 also discloses a handle which can be utilized to carry distinct types of storage members. This handle is not utilized in combination with wipe elements.

Various other prior art devices are known, including U.S. Pat. No. 4,536,889 which discloses a device that includes a wipe worn on a user's wrist. This device is not disclosed for use in cleaning an infant.

U.S. Pat. No. 3,692,202 discloses a handle for a liquid container. This handle is not used in combination with wipe elements.

U.S. Pat. No. 4,101,026 discloses a member for feeding premoistened towelettes from a dispenser.

U.S. Pat. Nos. 1,742,279; 4,206,529 and 4,580,695 all disclose various items that contain tissues, or other wiping elements and which include a handle.

None of the above-discussed U.S. Patents solve the problem discussed above. Prior art baby wipe containers having a slot at the top for removing wipes have, in some cases, utilized a handle. The handle utilized on these elements is, however, a handle integrally formed with the container and utilized for transporting the container.

It is thus an object of the present invention to disclose a handle for use in combination with a baby wipe container, and a method of using such a handle and container, to clean an infant.

SUMMARY OF THE INVENTION

A method for cleaning an infant is disclosed in which a wipe container has a handle placed on it. The wipe container is placed on a first hand of a user such that the container is on an outer side of the user's hands. The user's first hand is used to grasp an infant by the feet or legs to secure the infants legs. The user's second hand is then used to remove wipe elements from the container and clean the infant.

In one embodiment of the present invention, the handle includes a removable element including a pair of flexible resilient coaxial cylindrical members with a handle portion extending generally parallel to the axis of the two cylindrical portions, and interconnecting them. This handle portion is also resilient and allows a user's hand to fit between it and the container, securing the container to the hand.

A second embodiment of the present invention discloses a relatively resilient handle member attached to the outer surface of the cylindrical container. Again, the use of the resilient handle allows the container to be secured to the outer face of the user's hand.

In a most preferred embodiment of the present invention, the handles are relatively thin in thickness in comparison to their lateral width such that they do not occupy much space on the inner surface of the user's hand. This allows the user's hand to adequately grasp and secure the infant's legs.

These and other objects and features of the present invention can be best understood from the following specification and drawings of which the following is a brief description.

DETAILED DESCRIPTION OF A PREFERRED EMBODIMENT

Figure 1:
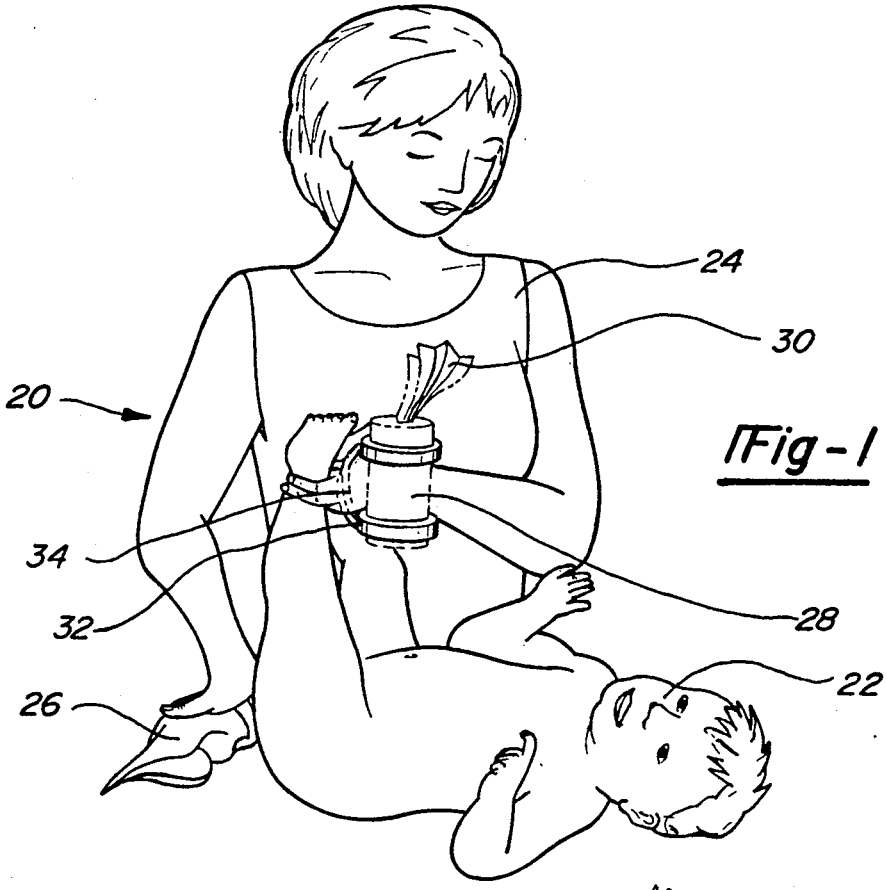
FIG. 1 is a perspective view showing the use of a handle according to the present invention being used to perform the method of the present invention.

An arrangement 20 used for cleaning infant is illustrated in FIG. 1. As shown, infant 22 lies on a planar surface and user 24 utilizes wipe 26 to clean the infant, as when changing the infant's diapers.

Wipe 26 is grasped by a user's hand 27. It should be understood that wipe 26 has been previously removed from wipe container 28. Wipe container 28 is of the sort having a slot at the top such that additional wipes 30 always extend through the slot for future removal.

A problem exists with the prior art since prior art containers generally require a first hand to secure the container while a wipe is removed with the user's other hand. Since the user must normally use one hand to secure the infant's legs, it is difficult to also secure the wipe container 28 and use another hand to remove a wipe 30. The described manipulation would typically require three hands. Thus, in the past, a single user may find it difficult to utilize a container of the sort illustrated at 28.

It is particularly important to secure the infant's legs during cleaning, since additional wipes 26 may be required during the process of cleaning infant 22. If legs 35 are not secured, as when removing an additional wipe, and are allowed to move about, the infant may spread fecal or other materials around the area where the cleaning is taking place. This is, of course, undesirable The present invention discloses handle 32 which allows container 28 to be secured to user's hand 34 which at the same time grasps the infant's legs 35. Thus, user 24 may use one hand 34 to secure legs 35 of infant 22 and also to secure container 28. The user's other hand 27 removes wipes 30 from container 28 for cleaning of infant 22.

Figure 2:
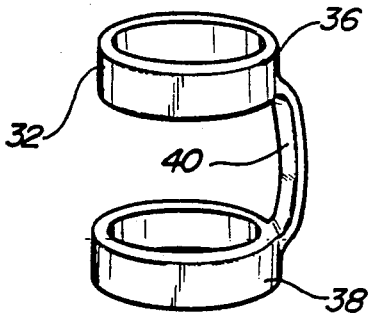
FIG. 2 is a perspective view showing one embodiment of the handle of the present invention.

Handle 32 is illustrated in FIG. 2 and consists of two generally cylindrical coaxial securing portions 36 and 38. Handle portion 40 extends generally parallel to the axis of portions 36 and 38 and connects the two. Handle portion 40 is flexible and relatively thin in thickness compared to its lateral width. Also, coaxial portions 36 and 38 are preferably flexible so that they may conform to the outer surface of various containers 28.

Figure 3:
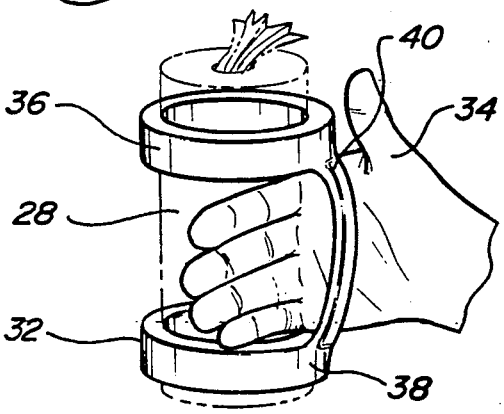
FIG. 3 is a perspective view showing the first embodiment of a handle according to the present invention securing a container to a user's hand.

The use of handle 32 on container 28 is illustrated in FIG. 3. Coaxial portions 36 and 38 are secured to the outer surface of container 28 at a top and bottom surface. Handle portion 40 extends between coaxial portions 36 and 38 and a user's hand 34 is placed between handle portion 40 and container 28. As illustrated, container 28 is placed on an outer side of user's hand 34, with handle portion 40 resting inside the user's palm. Since handle portion 40 is relatively thin, it does not occupy much space and hand 34 may also be used to secure the infant's legs 35.

The user may now use a single hand 34 to secure container 28 and also secure infants legs 35. The user's other hand 27 is used to remove wipes 30 from container 28. Handle 32 thus allows user 24 to simultaneously perform all three required steps in cleaning infant 22.

Figure 4:
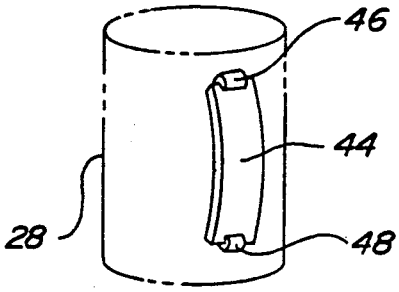
FIG. 4 is a perspective view showing a second embodiment of the present invention.

A second embodiment handle 44 is illustrated in FIG. 4. In this embodiment, container 28 includes upper and lower attachment members 46 and 48 at an outer surface. Handle 44 extends between members 46 and 48.

Figure 5:
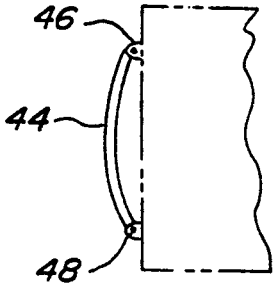
FIG. 5 is a cross-sectional view of the embodiment illustrated in FIG. 4.

As shown in FIG. 5, handle portion 44 is relatively thin in comparison to its lateral width and defines a space between handle portion 44 and container 28 for receiving user's hand 34.

Figure 6:
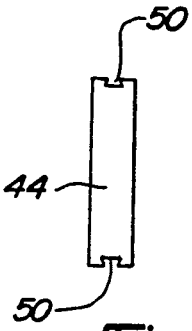
FIG. 6 is a plan view of the handle of the second embodiment of the present invention.

As shown in FIG. 6, handle portion 44 has notches 50 at each axial end which are secured on members 46 and 48.

A method according the present invention will now be disclosed with reference to the drawings. A handle, such as handle 32, is placed on container 28 with coaxial cylindrical members 36 and 38 received at top and bottom ends. User 24 then places hand 34 between handle portion 40 and container 28, such that container 28 is received on an outer side of the user's hand 34. The user's other hand 27 may then be used to remove wipes 30 from container 28 for cleaning the infant. If second embodiment 44 of the handle is utilized, it may not be necessary to attach the handle to the container 28, since the handle may be sold along with container 28.

A handle formed integral to the container may also be used to perform the method of this invention. Handle 32 is preferably formed of an appropriate rubber. Handle 44 is preferably formed of an appropriate plastic.

Preferred embodiments of the present invention have been disclosed, however, a worker in the art would realize that certain modifications would come with the scope of this invention and thus the following claims should be studied in order to determine the true scope and content of the invention.

I claim:

1. A method of utilizing a wipe to clean an infant comprising the steps of:

placing a handle on a wipe container;

placing the wipe container on one hand of a user such that the container is on an outer side of the one hand;

using the one hand to secure the infant's legs; and using the user's other hand to remove wipes from the container and manipulate them to clean the infant.

2. A method as recited in claim 1, wherein the container is of the type having a slot at an upper surface thereof, and the wipes must be removed from the slot.

3. A method as recited in claim 1, wherein the handle is removable from the container and reusable.

4. A method as recited in claim 3, wherein the handle includes a pair of coaxial cylindrical securing portions at upper and lower ends of the container and a handle portion extending parallel to the axis of the cylindrical portions, and connecting the two.

5. A method as recited in claim 4, wherein the handle is relatively thin in thickness compared to its lateral width, such that it occupies little space on an inner side of the user's hand.

6. A method as recited in claim 1, wherein the handle is attached to the container at attachment members at both an upper and lower end.

7. A method of utilizing a wipe to clean an infant comprising the steps of:

placing a handle on a wipe container wherein the wipe container is of the type having an opening at an upper surface and wherein wipes are removed from this opening by pulling them outwardly from the container;

placing the wipe container on one hand of a user such that the container is on an outer side of the one hand;

using the one hand to secure the infant's legs; and using the other hand to remove wipes from the container and manipulate them to clean the infant.

8. A method as recited in claim 7, wherein the handle is reusable and removable from the container and includes a pair of coaxial cylindrical securing portions at upper and lower ends, and a handle portion extending parallel to the axis of the cylindrical portions and interconnecting them, the handle portion being relatively thin in thickness when compared to its lateral width such that it occupies little space on an inner side of the user's one hand.

* * * * *